US007891219B1

(12) United States Patent
Gogel

(10) Patent No.: US 7,891,219 B1
(45) Date of Patent: Feb. 22, 2011

(54) LOCK GUARD FOR PADLOCK

(76) Inventor: Roy E. Gogel, 319 Garlington Rd., Suite C-1, Greenville, SC (US) 29615

( * ) Notice: Subject to any disclaimer, the term of this patent is extended or adjusted under 35 U.S.C. 154(b) by 0 days.

(21) Appl. No.: 12/559,097

(22) Filed: Sep. 14, 2009

Related U.S. Application Data

(63) Continuation-in-part of application No. 12/472,656, filed on May 27, 2009.

(60) Provisional application No. 61/060,838, filed on Jun. 12, 2008.

(51) Int. Cl.
*E05B 67/38* (2006.01)

(52) U.S. Cl. ..... 70/56; 70/203; 70/212; 70/417

(58) Field of Classification Search ..... 70/54–56, 70/DIG. 43, DIG. 56, 417, 202, 203, 211, 70/212; 292/148, 205, 218, 281, DIG. 32, 292/283, 285; D8/334, 335, 346
See application file for complete search history.

(56) References Cited

U.S. PATENT DOCUMENTS

| | | | | | |
|---|---|---|---|---|---|
| 1,220,941 | A | | 3/1917 | Bowers | |
| 1,244,404 | A | | 10/1917 | Ankovitz | |
| 3,392,555 | A | | 7/1968 | Beaver | |
| 3,808,847 | A | | 5/1974 | Vesely | |
| 3,828,591 | A | * | 8/1974 | Beaver | 70/56 |
| 3,884,057 | A | * | 5/1975 | Maurer | 70/259 |
| 4,290,281 | A | * | 9/1981 | Knaack et al. | 70/54 |
| 4,573,722 | A | * | 3/1986 | Lyng | 292/148 |
| 4,580,818 | A | * | 4/1986 | Lyng | 292/148 |
| 4,581,907 | A | | 4/1986 | Eberly | |
| 4,898,008 | A | | 2/1990 | Eberly | |
| 4,920,772 | A | | 5/1990 | Denison | |
| 5,000,494 | A | * | 3/1991 | Guibleo | 292/148 |
| 5,076,078 | A | * | 12/1991 | Weger, Jr. | 70/54 |
| 5,092,143 | A | * | 3/1992 | Rumbles | 70/56 |
| 5,219,384 | A | * | 6/1993 | Elsfelder et al. | 70/18 |
| 5,588,314 | A | * | 12/1996 | Knezovich | 70/56 |
| 5,806,351 | A | * | 9/1998 | Learnahan | 70/56 |
| 5,878,604 | A | * | 3/1999 | Stone et al. | 70/56 |
| 6,036,240 | A | | 3/2000 | Hamilton | |
| 6,622,533 | B1 | | 9/2003 | Santini | |
| 7,003,989 | B2 | | 2/2006 | St. James | |
| 7,201,027 | B2 | | 4/2007 | Gogel | |
| 7,201,028 | B1 | | 4/2007 | Gogel | |
| 7,278,284 | B1 | * | 10/2007 | James | 70/56 |
| 7,412,856 | B1 | | 8/2008 | Gogel | |

* cited by examiner

*Primary Examiner*—Lloyd A Gall
(74) *Attorney, Agent, or Firm*—John B. Hardaway, III; Daniel C. Leonardi; Nexsen Pruet, LLC

(57) ABSTRACT

A lock guard protects a padlock with a shackle and the ends of a securing connector. The device comprises a five-sided housing with an open bottom. Two opposing sides of the housing have opposing openings therethrough for inserting the ends of the securing connector. Inside the housing is a retaining tab having an opening therethrough dimensioned to receive the end of the shackle. The housing can also contain an abutment providing a surface against which to drive the top of the shackle when locking the padlock within the lock guard. When the retainer tab is vertical, the top edge of the hole in the retainer tab can act as an abutment.

18 Claims, 4 Drawing Sheets

LOCK GUARD FOR PADLOCK

CROSS REFERENCE TO RELATED APPLICATIONS

This application is a continuation-in-part of non-provisional application Ser. No. 12/472,656 filed on May 27, 2009, which in turn claimed the benefit of U.S. provisional patent application 61/060,838 filed Jun. 12, 2008.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not Applicable.

BACKGROUND OF THE INVENTION

Thieves use a variety of tools to break into fenced areas secured with a chain or cable and a padlock or to steal from retail stores displaying wheelbarrows, lawnmowers, barbecue grills, bicycles, motorcycles, or other large items outside. These tools include sledge hammers, acetylene cutting torches, saws, grinders and the like. In addition to these tools, the bolt cutter is a favored tool of burglars for cutting padlocks because of its portability and the fact that it can be used quickly and quietly allowing pilferage even in front of busy retail hardware stores in the middle of the day.

Retail products locked with a chain or cable are typically secured by a padlock that attaches the two open ends of the chain or cable to complete a circle that inhibits unwarranted removal of a retail item that has the securing connector threaded through it such that the item cannot be freely moved beyond a certain distance. Likewise, a gate can be secured by a chain and padlock by wrapping the chain around the swinging end of the gate and the post or pole to which it can be latched. In protecting a padlock used in this context, it is desirable to keep the lock guard relatively small to make it difficult for thieves to access the lock, yet sufficiently large so that the securing padlock's shackle is retained within the lock guard to minimize ready access. It is also desirable to provide a universal device that is not designed for a particular style cable or chain but is universally suitable for use with most chains or looped cables and most brands of padlocks.

For ages, two basic designs of lock boxes having four walls and a top have been used. One inconvenient design was a large box with a loop or bar inside the box for attaching the padlock and without an abutment as in the present invention. The chain or cable being locked was brought up through the bottom of the lock box. This box was inconvenient for two reasons. First, the user was forced to run the chain or cable up through the bottom of the box and could not see the relative position of the ends of the chain or cable once they were inside the box. This made capturing the cable or chain with the padlock difficult. Second, in order to lock the padlock, the user was required to reach inside the lock box. This was difficult and required the lock box to be larger than the present invention, which has an abutment for locking the padlock. The second design was comprised of a box fixed to a first door with a separate protruding element, typically bent, attached to a second door. The protruding element could be inserted into the box through a slot or opening in the back of the box on the first door and secured therein with a padlock. This design cannot be used in a free-standing environment. Thus there is a need for a convenient device for protecting padlocks used to secure the ends of connectors such as chains or cables where the lock is not attached to a bracket, latch, or other solid mounting surface.

Various attempts have been made to protect padlocks over the years, although most address the situation in which the padlock is locked to a wall or latch. Examples of such devices include those disclosed in U.S. Pat. No. 1,220,941 to Bowers, U.S. Pat. No. 1,244,404 to Ankovitz, U.S. Pat. No. 3,392,555 to Beaver, U.S. Pat. Nos. 4,581,907 and 4,898,008 to Eberly, and U.S. Pat. No. 6,622,533 to Santini.

Further attempts to protect locks are directed to bolt seals, as in U.S. Pat. No. 6,036,240 to Hamilton. Some attempts have been made to protect padlocks not secured to a door latch. Examples of such attempts include the devices disclosed in U.S. Pat. No. 3,808,847 to Vesely, U.S. Pat. No. 4,920,772 to Denison, and U.S. Pat. No. 7,003,989 to St. James. None of these devices, however, achieves the results of the present invention.

SUMMARY OF THE INVENTION

The herein disclosed lock guard shrouds the padlock's shackle and sides when fully engaged and secured so as to protect the lock from unauthorized tampering when securing a connecting device such as a cable or chain. The lock guard also protects the cable or chain at its point of connection with the padlock shackle. Moreover, the present invention protects the padlock without the benefit of a latch or solid mounting surface. With the present invention, in just a few seconds, a person can secure a swing gate or a number of free-standing, chained-together items with a padlock and at the same time protect the padlock from tampering.

The lock guard is specifically dimensioned to prevent access to the sides of the padlock and shackle through the lock guard's open bottom. That is, the lateral dimensions of the lock guard make it impossible for a thief to place a bolt cutter, a grinder, or even his/her hand within the lock guard. The lock guard does not however, obstruct access to the keyhole in the padlock and thus the padlock can be easily unlocked with the key. The lock guard can have side holes though which a securing connector, such as a chain, can be threaded and placed over the retainer tab, which is a shelf or plate in the lock guard with a hole in it dimensioned to receive the shackle of the lock. The lock can then be placed inside the lock guard, threaded through the ends of the securing connector and the retainer tab, and locked. To aid in locking the lock once it is in place, an abutment can be added above the retainer tab.

Another feature of the present invention is that it can be used with padlocks equipped with either standard or elongated shackles. For padlocks having elongated shackles, by providing a narrow vertical slot in the top wall, the lock guard can be used without expanding the lateral dimensions of the lock guard, which would make the sides and shackle of the padlock accessible and thus more vulnerable. The slot in the top wall allows the elongated shackle to temporarily extend out of the lock guard when the padlock is being installed. This allows the shackle to be raised above the retainer tab. Once the padlock is locked inside the lock guard, the shackle cannot be raised and pushed through the slot in the top wall.

In addition to the top slot, there is an additional slot in the front wall of the lock guard that permits the user to visually monitor the positions of the padlock, shackle, and the ends of the securing connector, when the padlock is being installed within the lock guard. The shackle must be threaded through the ends of the securing connector (e.g. the chain links at the ends of a chain or loops at the end of a cable) as well as through the retainer tab and the viewing slot facilitates this task.

Importantly, the top slot and front slot are sufficiently narrow to prevent insertion of an adult human finger or hand into the lock guard. Conveniently, the overall design of the lock guard is such that users can install a padlock in the lock guard without putting their hands into the lock guard. Additionally, the slots and openings in the lock guard are not large enough to permit a thief to get to the shackle of the padlock with a bolt cutter or grinding tool.

In another embodiment of the invention, the walls of the lock guard are without slots and the retainer tab is vertical instead of horizontal. With the retainer tab vertical, the upper perimeter of the hole in the retainer tab through which the shackle of the lock is threaded acts as an abutment to assist in locking the lock.

Accordingly, the present invention is compatible with and protects a broad range of padlocks, including padlocks with extended shackles, and protects the connecting device (e.g., a cable or chain) attached to the padlock's shackle, at the point of connection between the connecting device and the shackle.

BRIEF DESCRIPTION OF THE DRAWINGS

The invention is illustrated in the accompanying drawings, in which.

DETAILED DESCRIPTION OF EMBODIMENTS

Figure 1:
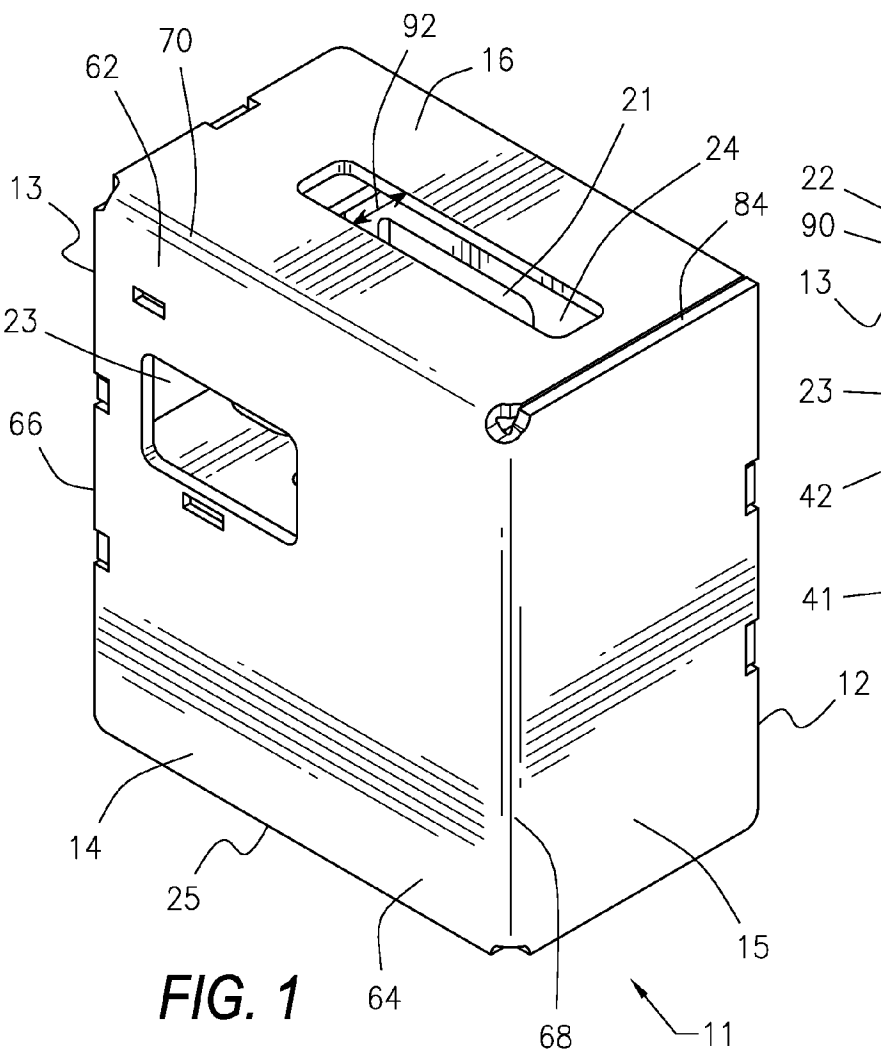
FIG. 1 is a perspective view of the outside of the lock guard according to one embodiment of the invention.
Figure 3:
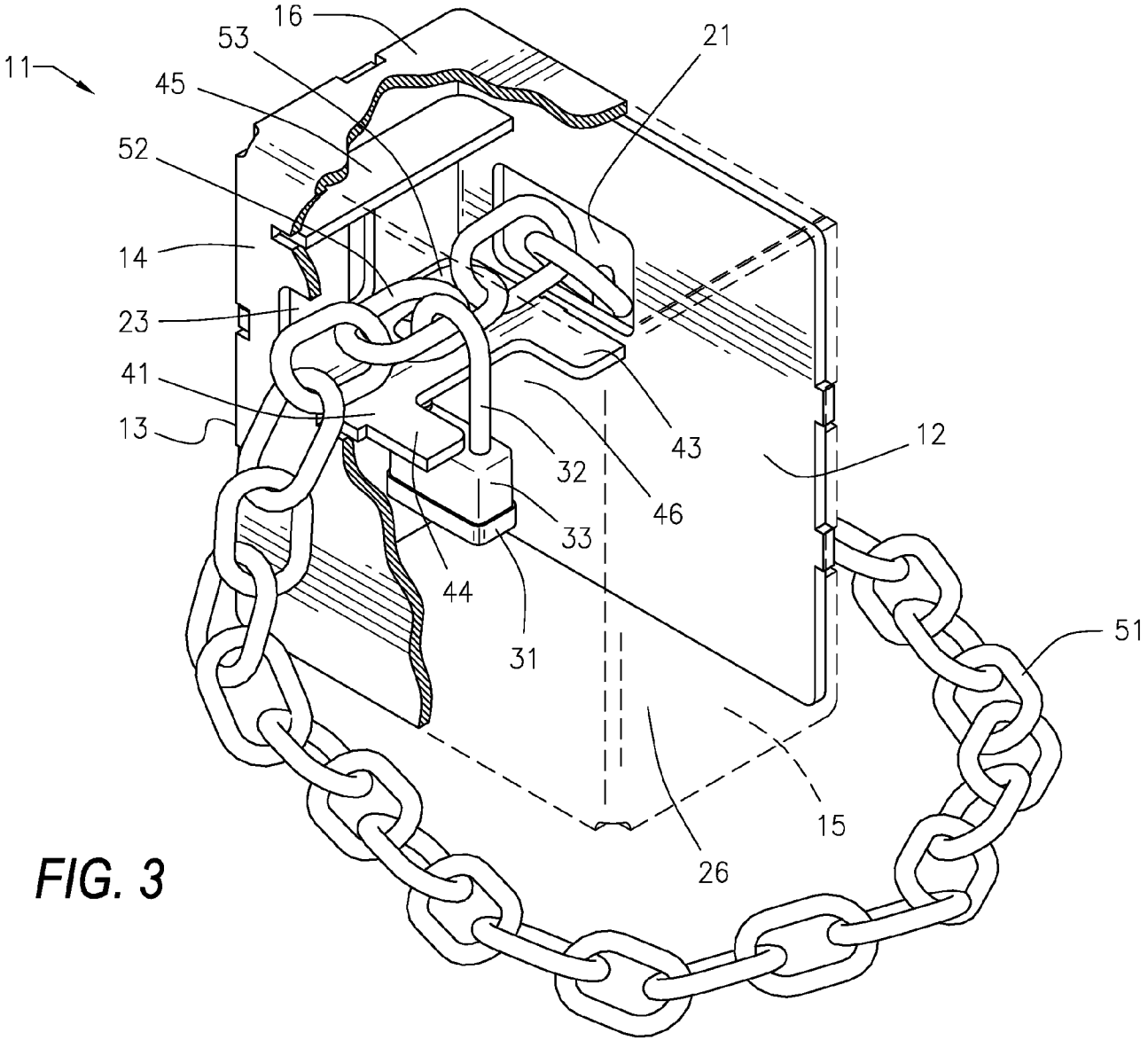
FIG. 3 is the same cut-away view of the lock guard as shown in FIG. 2, but with the addition of a chain secured with a padlock protected by the lock guard.

As illustrated in FIG. 1, the lock guard 11 consists of five walls: a front wall 13, side walls 12 and 14, a rear wall 15, and a top wall 16. Instead of having a sixth side or bottom wall, there is a bottom opening 25. Side walls 12 and 14 have openings 21 and 23, respectively. Openings 21 and 23 allow the respective ends of the securing connector (e.g., chain or cable, etc.) to be inserted into and removed from the lock guard 11 so the ends can be secured to the shackle of the padlock (FIG. 3). In this particular embodiment of the present invention, top wall 16 has an elongated slot 24 for temporary reception of the shackle of the padlock when the padlock is being installed in the lock guard 11. Slot 24 allows the lock guard 11 to be used with padlocks having elongated shackles without increasing the size of the lock guard 11.

Figure 2:
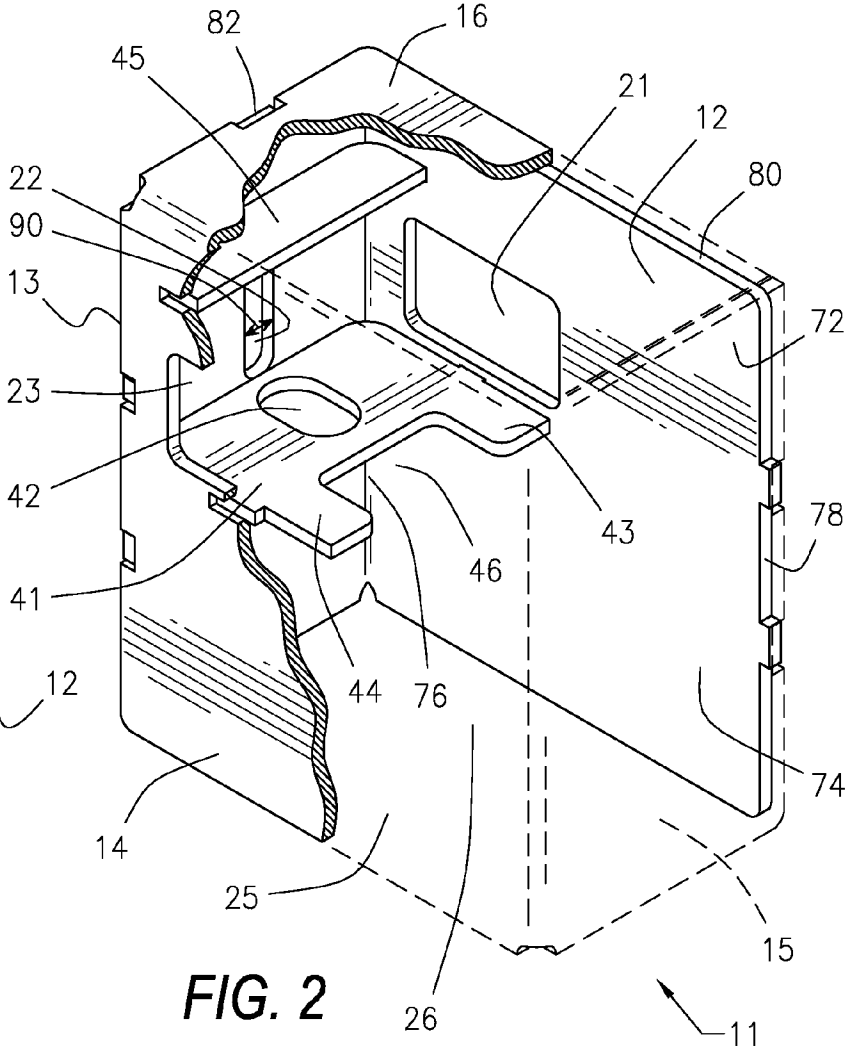
FIG. 2 is another perspective view of the lock guard according to one embodiment of the invention with portions of the housing cut-away to afford a view of the inside of the lock guard.

FIG. 2 is a perspective view of the lock guard 11 shown in FIG. 1 with portions of sides 14 and 16 removed and all of side 15 removed to show the inside of lock guard 11. The four side walls 12, 13, 14, and 15, along with top wall 16, form a cavity 26 that is accessible through bottom opening 25. Inside cavity 26 is a retainer tab 41 (located immediately below openings 21 and 23 in side walls 12 and 14).

Retainer tab 41 has at least three functions. First, having a hole therein dimensioned to receive the shackle of the padlock, it serves as the point of connection for the padlock. Second, when the retainer tab is permanently fastened to side walls 12 and 14 and front wall 13, it serves to reinforce the lock guard 11. Third, in an embodiment of the present invention in which retainer tab 41 has spacer bars 43 and 44 defining a gap 46, retainer tab 41 and spacer bars 43 and 44 serve to prevent the shackle 32 from being brought sufficiently close to openings 21 and 23 that it could be cut with a bolt cutter or other tool (see FIG. 3). Note also that the opening 42 in retainer tab 41 is located laterally in the center of retainer tab 41 so that a user can see the shackle and its position with respect to retainer tab 41 through slots 22 and 24 while securing the padlock to the lock guard 11.

Cavity 26 can also contain an abutment 45. Abutment 45 is located above front wall opening 22 and below top wall 16. Abutment 45 serves as a surface against which the shackle of the padlock can be pushed when the user locks the padlock inside the lock guard 11. Similar to retainer tab 41, abutment 45 can be secured to side walls 12 and 14 as well as front wall 13, and extends in a rearward direction for a distance shorter than the full width of opening 42.

FIG. 3 is a perspective cut-away like FIG. 2 but, unlike FIG. 2, shows a padlock 31 and a securing connector, a chain 51. As shown in FIG. 3, padlock 31 secures a connecting device, such as chain 51, within the cavity 26 of lock guard 11. To lock the padlock 31 inside lock guard 11, the user inserts the padlock 31, with the padlock's shackle 32 in the open position (not shown), through the bottom opening 25 of the lock guard and into cavity 26. The shackle 32 of the padlock 31 is then raised above vertical gap 46 as formed by the left spacer 43 and right spacer 44 of the horizontal retainer tab 41. If necessary, the shackle 32 can extend through elongated slot 24 of top wall 16 (FIG. 1) to ensure that the shackle 32 is above retainer tab 41. Connector ends 52 and 53 of chain 51 are placed through the side wall openings 21 and 23 and positioned on top of retainer tab 41, as shown in FIG. 3. The open shackle 32 is then threaded through securing device ends 52 and 53 and opening 42 of retainer tab 41. The lock body 33 is then rotated to align the lock body 33 with the shackle 32. The padlock 31 is then raised so that the top curve of the shackle 32 bears on the abutment 45 permitting padlock 31 to be locked. The securing device ends 52 and 53 and padlock 31 are then locked securely within lock guard 11. When needed, padlock 31 is easily unlocked (with a key) through bottom opening 25.

Figure 4:
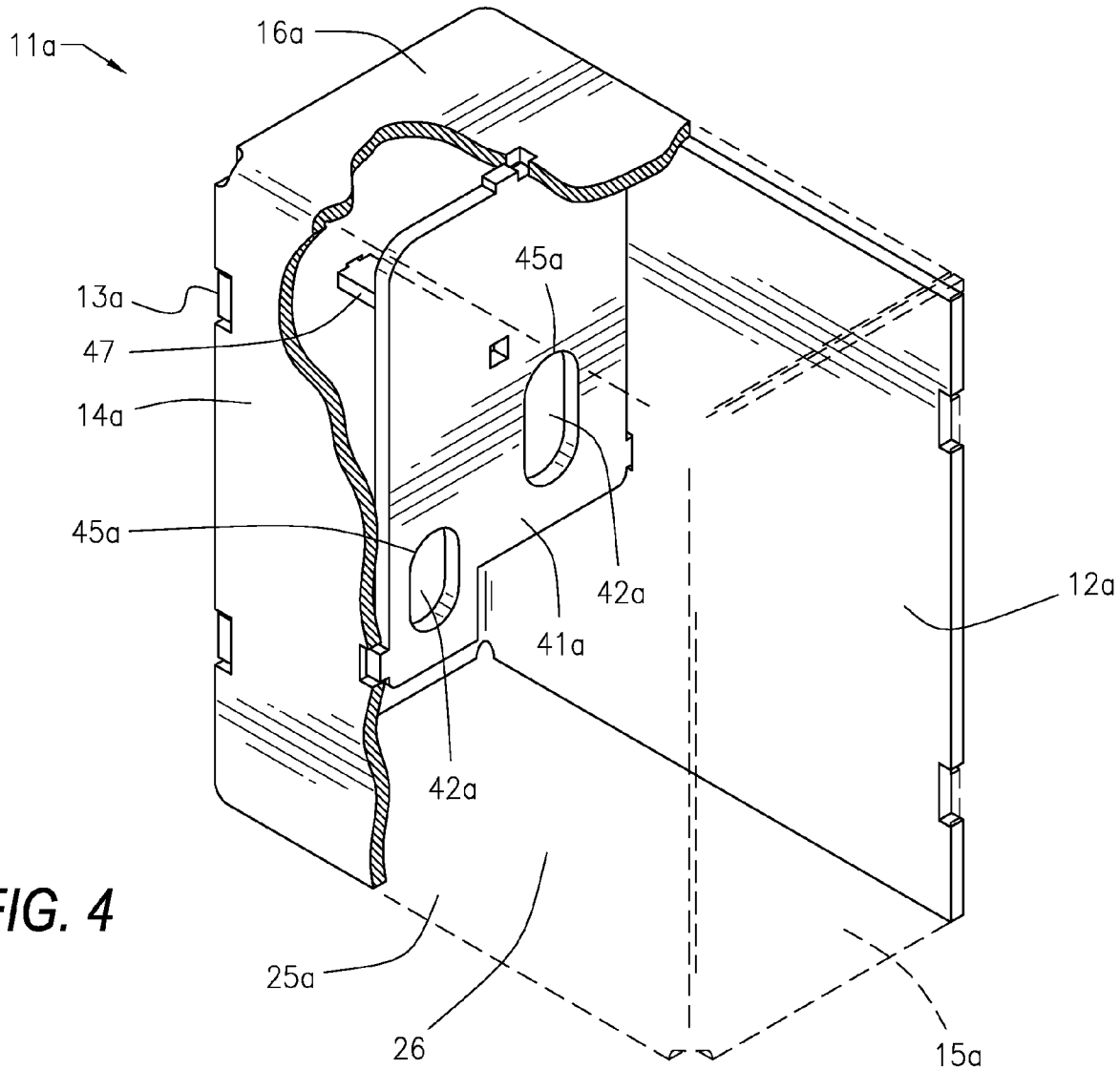
FIG. 4 is a perspective cut-away view of another embodiment of the invention.

FIG. 4 is a perspective cut-away of another embodiment 11*a* of the invention. The walls 12*a*, 13*a*, and 14*a* in this embodiment do not have slots or holes therethrough. Furthermore, retainer tab 41*a*, instead of being horizontal within the lock guard 11*a*, is vertical. The retainer tab 41*a* can be attached to top wall 16*a* and side walls 12*a* and 14*a* and be further supported with a support 47 spanning between retainer tab 41*a* and the front wall 13*a*. The retainer tab 41*a* can have one or more openings 42*a* through which the shackle of the lock can be threaded. The top edges 45*a* of openings 42*a* act as abutments against which the shackle 32*a* of the padlock 31*a* can be forced, making locking of the padlock 31*a* within the device 11*a* very easy.

Figure 5:
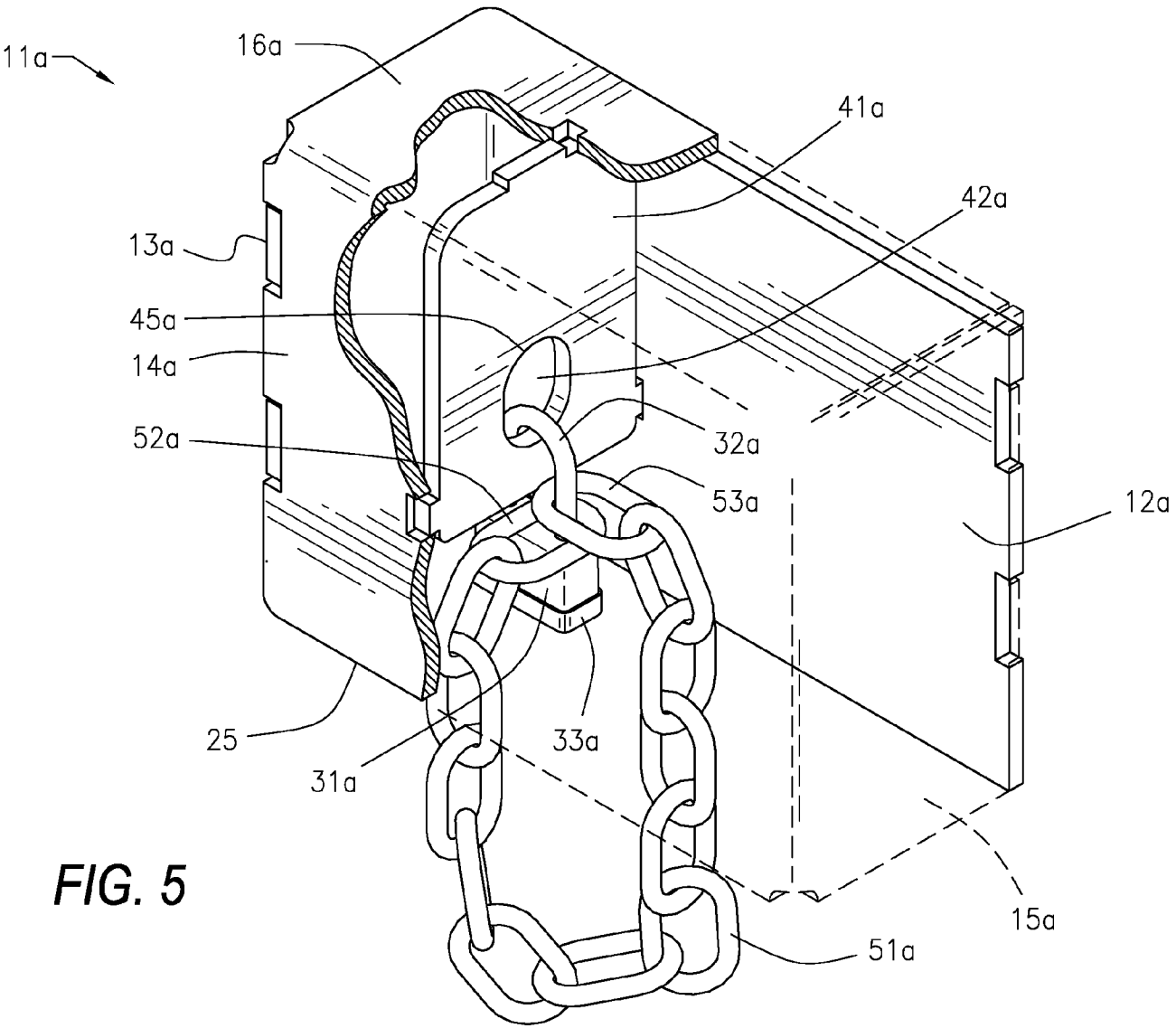
FIG. 5 is the same cut-away view of the lock guard as shown in FIG. 4, but with the addition of a chain secured with a padlock protected by the lock guard.

FIG. 5 is a perspective cut-away of an embodiment 11*a* of the invention similar to that shown in FIG. 4 having a vertical retainer tab 41*a*. Here, as in FIG. 3, a padlock 31*a* and connector 51*a* are shown secured within the invention 11*a*. To lock the padlock 31*a* within the invention 11*a*, the user threads the ends 52*a* and 53*a* through the shackle 32*a* of the padlock 31*a* and inserts the padlock 31*a* into the invention

11*a* with the shackle 32*a* in the unlocked and open position (not shown). The shackle 32*a* is then threaded through hole 42*a* in retainer tab 41*a* and the padlock 31*a* can then be locked. As explained above, the top edge 45*a* of hole 42*a* acts as an abutment against which the top curve of shackle 32*a* can be forced to lock the padlock 31*a*. As with the other embodiments of the invention herein disclosed, the padlock 31*a* can be easily removed with a key as the bottom of the lock 33*a* is accessible through the bottom 25*a* of the device 11*a*.

As shown in FIGS. 1 and 2, side walls 14 and 12 have top halves 62 and 72, bottom halves 64 and 74, fore edges 66 and 76, and aft edges 68 and 78, respectively. Top halves 62 and 72 have top edges 70 and 80, respectively, front wall 13 has a top edge 82, and back wall 15 has a top edge 84. Finally, slots 22 and 24 have widths 90 and 92.

Having hereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A lock guard for use with a padlock having a body and a shackle with a top curve and a securing connector having two ends, said lock guard comprising:

a housing including an opposing pair of laterally spaced-apart and parallel rectangular side walls, each of said side walls having a top half, a bottom half, a fore edge, and an aft edge, said top half having a top edge and an opening therethrough dimensioned to receive at least one end of said two ends of said securing connector;

a rectangular front wall attached to and spanning between said fore edges of said side walls, said front wall having a top edge;

a rectangular back wall attached to and spanning between said aft edges of said side walls and having a top edge;

a top wall attached to said top edges of said side walls, said front wall, and said back wall;

a retainer tab attached to said front wall, said retainer tab extending rearward from said front wall and having an opening therethrough dimensioned to receive a portion of said shackle; and an abutment attached to said front wall, said abutment positioned between said retainer tab and said top wall so that, when said two ends of said securing connector are positioned on said retainer tab and said shackle is threaded through said two ends and said opening in said retainer tab and then said top curve of said shackle is forced against said abutment thereby forcing said shackle into said body, said padlock and said ends are locked inside said lock guard.

2. The lock guard as recited in claim 1 wherein said top wall has an elongated slot therethrough dimensioned to receive said top curve, said slot being substantially centrally spaced between said side walls and having a longitudinal axis substantially parallel with said top edges of said side walls.

3. The lock guard as recited in claim 1 wherein said retainer tab is attached to said side walls.

4. The lock guard as recited in claim 1 wherein said abutment is attached to said side walls.

5. The lock guard as recited in claim 1 wherein said retainer tab has two spaced-apart spacer bars that extend rearward from said retainer tab defining a gap, at least a portion of said shackle passing through said gap when said padlock is locked to said retainer tab, said spacer bars dimensioned so that, when said padlock is locked to said retainer tab, said shackle cannot be brought near said side walls to be cut with a tool through said openings in said side walls.

6. The lock guard as recited in claim 1 wherein said retainer tab has two spaced-apart spacer bars that extend rearward from said retainer tab defining a gap, at least a portion of said shackle passing through said gap when said padlock is locked to said retainer tab.

7. The lock guard as recited in claim 1 wherein said front wall has a top half and a bottom half and said top half has a viewing slot therethrough.

8. A lock guard for use with a padlock having a body and an elongated shackle with a top curve and a securing connector having two ends, said lock guard comprising:

a housing including an opposing pair of laterally spaced-apart rectangular side walls, each of said side walls having a top half, a bottom half, a fore edge, and an aft edge, said top half having a top edge and an opening therethrough dimensioned to receive at least one end of said two ends of said securing connector;

a rectangular front wall attached to and spanning between said fore edges of said side walls, said front wall having a top edge;

a rectangular back wall attached to and spanning between said aft edges of said side walls and having a top edge;

a top wall attached to said top edges of said side walls, said front wall, and said back wall, said top wall having an elongated slot therethrough dimensioned to receive said top curve, said slot being substantially centrally spaced between said side walls and having a longitudinal axis substantially parallel with said top edges of said side walls; and a retainer tab attached to said front wall, said retainer tab extending rearward from said front wall and having an opening therethrough dimensioned to receive a portion of said shackle; and an abutment attached to said front wall, said abutment positioned between said retainer tab and said top wall so that, when said top curve is inserted into said elongated slot and said two ends of said securing connector are positioned on said retainer tab and then said shackle is threaded through said two ends and said opening in said retainer tab and said top curve of said shackle is forced against said abutment thereby forcing said shackle into said body, said padlock and said ends are locked inside said lock guard.

9. The lock guard as recited in claim 8 wherein said retainer tab is attached to said side walls.

10. The lock guard as recited in claim 8 wherein said abutment is attached to said side walls.

11. The lock guard as recited in claim 8 wherein said front wall has a top half and a bottom half and said top half has a viewing slot therethrough.

12. The lock guard as recited in claim 8 wherein said retainer tab has two spaced-apart spacer bars that extend rearward from said retainer tab defining a gap, at least a portion of said shackle passing through said gap when said padlock is locked to said retainer tab, said spacer bars dimensioned so that, when said padlock is locked to said retainer tab, said shackle cannot be brought near said side walls to be cut with a tool through said openings in said side walls.

13. The lock guard as recited in claim 8 wherein said retainer tab has two spaced-apart spacer bars that extend rearward from said retainer tab defining a gap, at least a portion of said shackle passing through said gap when said padlock is locked to said retainer tab.

14. The lock guard as recited in claim 11 wherein said slot in said top wall has a first width and said viewing slot has a second width, and wherein said first width and said second width are each not more than ⅝ of an inch.

15. A lock guard for use with a padlock having a body and a shackle with a top curve and a securing connector having two ends, said lock guard comprising:

a housing including an opposing pair of laterally spaced-apart and parallel rectangular side walls, each of said side walls having a fore edge, an aft edge, and a top edge;

a rectangular front wall attached to and spanning between said fore edges of said side walls, said front wall having a top edge;

a rectangular back wall attached to and spanning between said aft edges of said side walls and having a top edge;

a top wall attached to said top edges of said side walls, said front wall, and said back wall;

a retainer tab attached to said front wall, said retainer tab extending rearward from said front wall and having an opening therethrough dimensioned to receive a portion of said shackle; and an abutment attached to said front wall, said abutment positioned between said retainer tab and said top wall so that, when said two ends of said securing connector are positioned on said retainer tab and said shackle is threaded through said two ends and said opening in said retainer tab and then said top curve of said shackle is forced against said abutment thereby forcing said shackle into said body, said padlock and said ends are locked inside said lock guard.

16. A lock guard for use with a padlock having a body and a shackle with a top curve and a securing connector having two ends, said lock guard comprising:

a housing including an opposing pair of laterally spaced-apart and parallel rectangular side walls, each of said side walls having a fore edge, an aft edge, and a top edge;

a rectangular front wall attached to and spanning between said fore edges of said side walls, said front wall having a top edge;

a rectangular back wall attached to and spanning between said aft edges of said side walls and having a top edge;

a top wall attached to said top edges of said side walls, said front wall, and said back wall;

a retainer tab spanning between and attached to said side walls, said retainer tab having at least one hole therethrough, each hole of said at least one hole having a top edge, said housing dimensioned and said retainer tab positioned and secured within said housing so that, when said shackle is threaded through said two ends of said securing connector and said at least one hole in said retainer tab, and said top curve of said shackle is forced against said top edge of said at least one hole forcing said shackle into said body, said padlock and said ends are locked inside said lock guard.

17. The lock guard as recited in claim 16 wherein said retainer tab is attached to said top wall.

18. The lock guard as recited in claim 16, further comprising:

a support, said support spanning between said retainer tab and said front wall so that said retainer tab is further supported within said housing.

* * * * *